United States Patent [19]

Swahl et al.

[11] Patent Number: 4,838,457

[45] Date of Patent: Jun. 13, 1989

[54] LOTION BLENDING AND DISPENSING UNIT

[76] Inventors: James C. Swahl; Debra A. Swahl, both of 4141 Kling St., #2, Burbank, Calif. 91505

[21] Appl. No.: 191,380

[22] Filed: May 9, 1988

[51] Int. Cl.[4] ..... B65D 35/28; B67D 5/22

[52] U.S. Cl. ..... 222/48; 222/94; 222/95; 222/105; 222/144.5; 222/145; 222/209; 222/548; 239/312; 239/414

[58] Field of Search ..... 222/94, 95, 105, 183, 222/135-137, 145, 144.5, 142.9, 209, 212, 386.5, 548, 42, 44, 47, 48; 239/305, 312, 413, 414

[56] References Cited

U.S. PATENT DOCUMENTS

| | | | |
|---|---|---|---|
| 1,989,468 | 1/1935 | Spencer | 239/414 |
| 2,777,612 | 1/1957 | Bensen | 222/209 |
| 3,211,343 | 10/1965 | Silver | 222/144.5 |
| 3,416,707 | 12/1968 | Pollard | 222/94 X |
| 4,006,841 | 2/1977 | Alticosalian | 222/144.5 X |
| 4,020,978 | 5/1977 | Szczepanski | 222/209 |
| 4,147,278 | 4/1979 | Uhlig | 222/95 X |
| 4,335,837 | 6/1982 | Bono | 222/145 X |
| 4,549,674 | 10/1985 | Alticosalian | 222/144.5 X |
| 4,585,149 | 4/1986 | Zulauf | 222/94 |

FOREIGN PATENT DOCUMENTS

| | | | |
|---|---|---|---|
| 2017292 | 10/1971 | Fed. Rep. of Germany | 222/94 |
| 2516054 | 5/1983 | France | 222/94 |
| 2064664 | 6/1981 | United Kingdom | 222/145 |

*Primary Examiner*—Kevin P. Shaver
*Attorney, Agent, or Firm*—Roger A. Marrs

[57] ABSTRACT

A lotion blending and dispensing unit is disclosed herein for internally combining and then discharging a composite lotion or solution which includes a cylindrical housing having a storage chamber for enclosing at least a pair of lotion containers removably mounted on a mounting block. The block is provided with at least a pair of orifices on an annular surface having a central projection about which a selector dial rotates. The projection includes at least a pair of passageways in fixed alignment with the orifices so as to conduct lotion therethrough. A regulating disc is movably disposed on the annular surface for revolving about the projection whereby a plurality of different sized apertures may be selectively aligned between the orifices and the passageways. The disc is movable in response to rotation of the selection dial.

12 Claims, 1 Drawing Sheet

LOTION BLENDING AND DISPENSING UNIT

BACKGROUND OF THE INVENTION

1. Field of the Invention

The present invention relates to a dispensing unit for combining a plurality of lotions and for dispensing the composite lotion, and more particularly to a novel blending and dispensing unit wherein a plurality of lotions are selectively introduced to a mixing or blending chamber followed by dispensing of the resultant composition so that the ultimate discharge from the unit is a selective blend of the combined lotions through a discharge orifice in an outer container.

2. Brief Description of the Prior Art

In the past, it has been the conventional practice to provide multiple compartment dispensers which require that individual lotions or substances be introduced into separate compartments in a container and then sealing the container whereby eventual squeezing or depression of the container causes the separate ingredients to be discharged through a common orifice. In some instances, the separate substances are mixed externally of the container during the squeezing or expulsion procedure. One such container is shown in U.S. Pat. No. 3,197,071 wherein separate substances are introduced into a chamber when the cap has been removed. Therefore, it can be seen that such a device mixes ingredients externally of the container as the device or dispenser is being used. There is no internal mixing chamber that premixes the variety of substances prior to the dispensing or expulsion procedure. Also, there is no selection means associated with the container for providing a wide selection of blending proportions. The orifices leading from the separate substance containers are fixed and cannot be adjusted to suit the needs of the user.

Other dispensing devices, such as shown in U.S. Pat. No. 4,380,307, merely provide for separate dispensing of a variety of stored substances without blending or mixing preparatory to dispensement. Another such device is shown in U.S. Pat. No. 4,288,006. Therefore, in all of the above-mentioned prior devices, blending or mixing of the substance takes place outside of the container and no means are shown for premixing the variety of substances by the user in accordance with a proportion selector means. In other words, the user can blend proportions according to his taste or desire external of the container or the user is limited to a fixed proportion without the capability of adjustment.

Therefore, a long standing need has existed to provide a novel blending and dispensing unit for selectively combining a plurality of individual solutions, lotions or substances wherein the proportions can be readily selected by the user during the dispensing procedure.

SUMMARY OF THE INVENTION

Accordingly, the above problems and difficulties are obviated by the present invention which provides a novel blending and dispensing unit for a multiplicity of substances, lotions or solutions which includes a cylindrical housing or container having an internal storage chamber enclosing a plurality of individual tubes containing the lotion, substance or solution intended to be combined and dispensed. The container includes a body portion having orifices terminating at an annular surface in alignment with the respective plurality of containers for the lotion, substance or solution. The container further includes a central projection extending above the annular surface about which a rotary disc is disposed which is provided with a plurality of different sized orifices movable about the projection in selected registry with the orifices opening at the annular surface. The projection further includes a conical portion overlapping the disc which is provided with passageways in fixed alignment with the orifices of the annular surface so that lotion, substance or solutions may be passed therethrough when the apertures in the disc are indexed between the orifices and the passageways respectively. A dial is rotatably carried about the projection and includes means attachable to the disc so that the disc may be rotated to selective locations. Alpha-numeric or graphic representations can be carried on the container and the dial respectively for the use of the user in selecting proper aperture alignment between the orifices and passageways.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
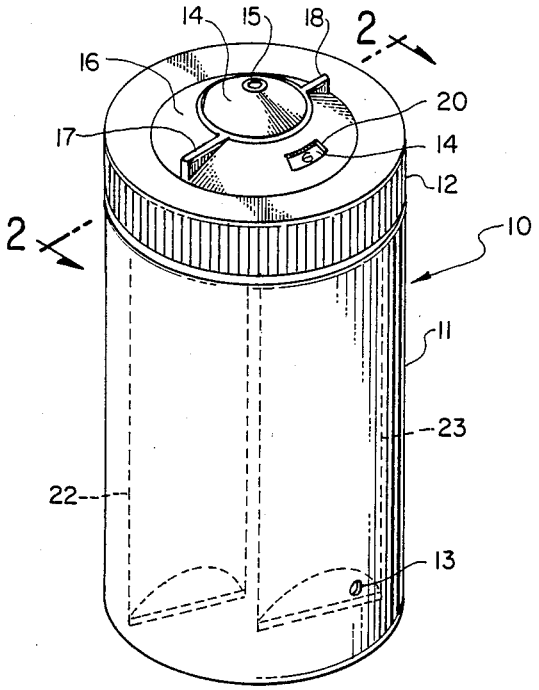
FIG. 1 is a front perspective view showing the novel lotion blender and dispensing unit incorporating the present invention.

Referring to FIG. 1, the novel blender and dispenser unit of the present invention is illustrated in the general direction of arrow 10 which includes an outside housing 11 of cylindrical configuration having a closed bottom and a removable top 12. The top is arranged in threadable engagement with the upper end of the housing 11 and the housing is further provided with an opening 13 communicating an interior storage compartment or chamber with ambient environment. The user controls discharge or disbursement of the stored substances or ingredients by closing the opening 13 with a thumb or finger at the time of dispensing. Also, it is to be understood that the housing is composed of a transparent or translucent material so that the interior can be visually inspected to check the quantity of lotions or solutions available for mixing during the dispensing procedure. The lid 12 includes a central opening through which a conical projection 14 extends, which terminates in a dispensing orifice 15. Movably mounted on the conical projection 14 is a dial 16 having raised portions 17 and 18 suitable for grasping by the fingers of the user in order to rotate the selector dial 16 about the conical projection 14. The dial further includes a window or elongated opening 20 exposing a portion of the underlying conical projection 14 that carries indicia or graphic representations intended to be used for selection purposes in determining proportions of a blend of the plurality of substances, lotions or solutions contained within the housing 11.

Figure 2:
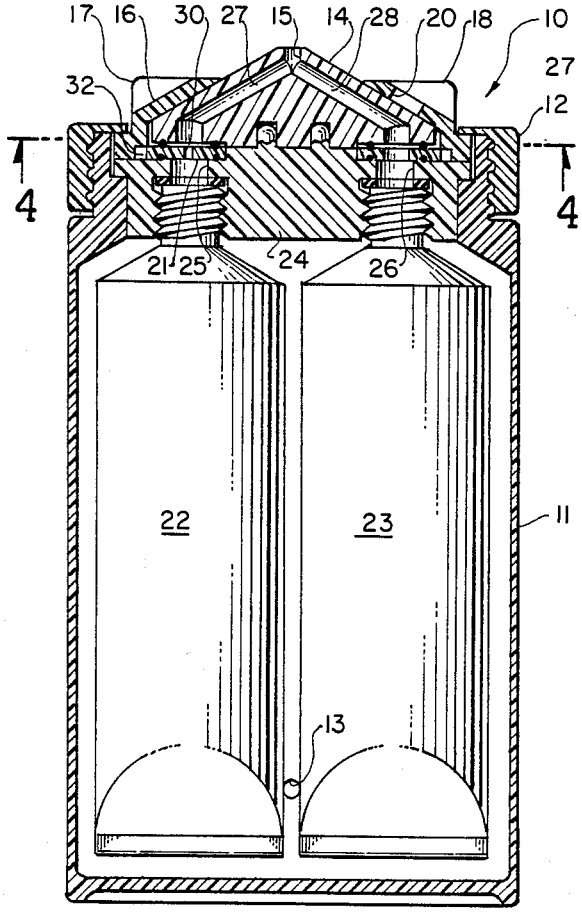
FIG. 2 is an enlarged longitudinal cross-sectional view of the blending and dispensing unit of the present invention.
Figure 5:
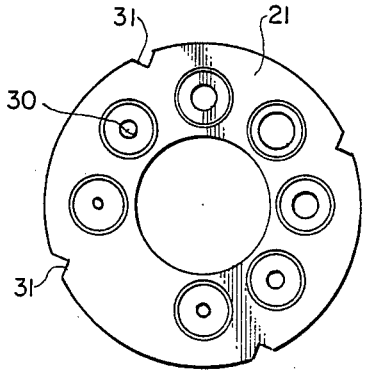
FIG. 5 is a top plan view of the regulating aperture disc disposed between the orifices on the annular surface of the container and the passageways shown in the dispensing projection.

Referring now in detail to FIG. 2, it can be seen that the housing 11 includes an internal storage chamber in which a pair of containers 22 and 23 are located, each of which contain a different lotion, solution or substance. It is to be understood that although a pair of containers is shown, multiple containers can be employed so that a multiple of substances can be blended or combined and subsequently dispensed as a common composition. Each of the respective containers 22 and 23 is suitably engaged with receiving sockets in a mount 24 disposed to close the storage chamber of the housing 11 at one end. The mount 24 includes a pair of openings 25 and 26 which communicate the respective nozzles of the containers 22 and 23 with an annular surface 27 on which the regulating aperture disc 16 rides. The mount 24 further supports the conical member 14 so that the opposite ends of passageways 27 and 28 interconnect the dispensing orifice 15 with the openings 25 and 26 respectively. However, it is to be understood that the disc 21 interferes with communication between the passageways and the openings. The disc 21 is shown more clearly in FIG. 5 which includes a plurality of different sized openings, such as openings 30, so that when a selected opening is in registry between the openings 24 and its respective passageway or opening 25 with its respective passageway 27, the substance contained within the containers will be permitted to pass into blending relationships at the orifice 15.

Figure 3:
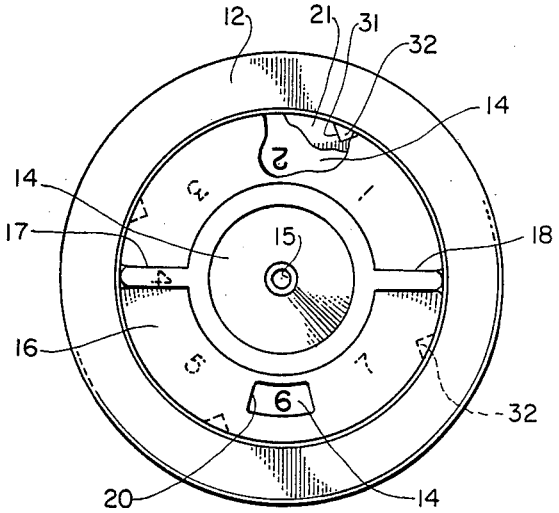
FIG. 3 is a fragmentary top plan view of the blending and dispensing unit.

It is to be particularly noted that the disc 21 includes a plurality of notches, such as notch 31, into which projections, such as projection 32 of FIG. 3 is inserted or engaged. Therefore, the selector dial 16 is connected to the regulating aperture disc 21 by means of the projections 32 disposed within the respective notches 31. Therefore, as the dial is rotated, the disc will rotate in accordance therewith.

Figure 4:
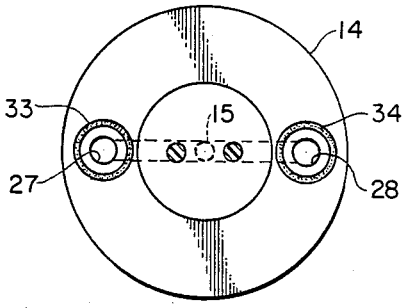
FIG. 4 is a sectional view of the blending and dispensing unit substantially as taken in the direction of arrows 4—4 of FIG. 2.

Also, it is to be noted that the conical projection 14 includes a plurality of numerals arranged in a circular path about its surface wherein each numeral is adjacent to a specifically sized aperture. For example, the numeral 6 is located adjacent to aperture 30 and when the disc has been rotated to the position where the user desires this size opening to interconnect one of the containers with a particular passageway, the numeral will appear through the window 20. Also, it is to be noted that each of the respective openings in the regulating aperture disc 21 includes a recessed seat for accommodating the presence of an O-ring. The O-rings are shown in FIG. 4 and identified by numerals 32 and 33 and are arranged in association with the ports for passageways 27 and 28. Therefore, as the disc 21 rotates, the O-rings will drop into the respective recesses about each of the selected apertures 30 and provide a seal so that the lotion or substance flowing through the aperture will not leak.

Therefore, it can be seen from the foregoing that the blending and dispensing unit of the present invention provides a novel means for storing a plurality of substances such as suntan lotion, suntan blocks or the like, and that these substances can be selectively withdrawn from respective containers 22 and 23 into a proportioned blend via the passageways 27 and 28 in accordance with the desired sized apertures in the rotating disc 21. An aperture of one size can be in registry between the opening 25 and the passageway 27 while a different sized aperture in the disc can be indexed or registered between opening 26 and the passageway 28. Therefore, different quantities of substances can be introduced to the blending nozzle 15 preparatory to leaving the unit for application to the skin of the user. Initially, the selector dial 16 is moved by the user to a desired indicator number on the disc 21 as viewed through the window 20 which positions the apertures over the lotion and block tubes 22 and 23 orifices respectively. The outer container is grasped and squeezed in a manner that the thumb of the user is postioned over and sealing the air hole 13. Air pressure inside the container applies an even pressure to the pliable lotion and block tubes 22 and 23 regardless of how spent their contents may be. The lotion and block are forced through the selected regulating apertures and discharged in the desired suntan lotion and block blend. The thumb is removed from the air hole and the container regains form.

Figure 6:
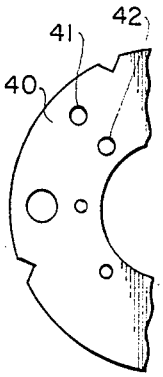
FIG. 6 is an alternate regulator disc.

The alternate disc shown in FIG. 6 by numeral 40 includes multiple circular paths of apertures, such as 41 and 42, for blending a greater variety of substances. Additional passages are included in the projection 16 for alignment with the respective circular paths of apertures.

The housing 11 is suitable to be wall mounted or disposed on a sink or table top.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A device for proportionally blending and dispensing selected substances from a variety of substances, the combination comprising:

a deformable housing having an internal storage chamber communicating to ambient environment via a control hole;

a plurality of flexible containers within said housing storage chamber, each of which includes a nozzle for discharging a substance held in a respective container;

means fixedly carried on said housing for dispensing blended and mixed substances;

rotating regulatory means operably disposed between said dispensing means and said container nozzles and having a plurality of apertures registering selectively with said respective nozzles and said dispensing means; and selector means operably connected to said rotating regulatory means for positioning said regulatory means to align desired apertures with said nozzles and said dispensing means.

2. The invention as defined in claim 1 wherein:

said dispensing means includes multiple passageways having open ends adapted to be placed in fluid communication with said respective nozzles via said regulatory means apertures.

3. The invention as defined in claim 2 wherein:
said regulatory means is a disc disposed between said plurality of nozzles and said open passageways;
sealing means disposed between each of said apertures and said regulatory means and dispensing means respectively.

4. The invention as defined in claim 3 wherein:
said selector means includes a manually movable member mounted on said dispensing means and engagement means detachably coupling said member with said regulatory means whereby said disc is positionable in response to movement of said member.

5. The invention as defined in claim 4 wherein:
said engagement means includes at least one notch on the periphery of said disc cooperating with a conformal projection on said dispensing means member.

6. The invention as defined in claim 5 wherein:
said housing includes a mount closing one end of said housing and provided with openings in communication with each of said container nozzles; and
said regulatory means rotatably carried on said mount and having selected ones of its apertures alignable with said mount opening for conducting selected flowable substances from said containers to said dispensing means.

7. The invention as defined in claim 6 wherein:
said dispensing means includes a discharge duct coupling said ends of said passageways together and constituting a blending chamber for mixing substances selected from said containers via said regulatory means apertures into a composite substance preparatory for discharge externally of said dispensing means.

8. The invention as defined in claim 7 including:
means for expelling substance from said containers comprising said internal storage chamber within said housing;
said containers disposed in said storage chamber and detachably carried on said housing mount; and
said control hole provided in said housing communicating said storage chamber exteriorly of said housing to ambient atmosphere, whereby manual closing of said housing hole with deformation of said housing pressurizes said storage chamber to forcibly urge substance through said nozzles.

9. The invention as defined in claim 8 wherein:
said regulatory means disc includes said plurality of apertures arranged in a pair of circular rows concentrically disposed with respect to one another and coaxially disposed with respect to said disc; and
each of said rows lying adjacent to the open ends of selected ones of said dispensing means passageways.

10. The invention as defined in claim 9 wherein:
said dispensing means is of conical shape seated on and fixed to said housing mount;
said selector means being of circular configuration having a central opening through which said conical dispensing means projects to expose said discharge duct for external discharge of said composite substance; and
said selector means having a peripheral portion rotatably engaged with said housing mount beyond the periphery of said regulatory means disc.

11. The invention as defined in claim 10 including:
means cooperating between said selector means and said dispensing means for indicating proportional blend of said substances forming said composite substance.

12. The invention as defined in claim 11 wherein:
said indicator means includes an opening in said selector means exposing indicia carried on said underlying dispensing means.

* * * * *